US007610960B2

(12) United States Patent
Mendez et al.

(10) Patent No.: US 7,610,960 B2
(45) Date of Patent: Nov. 3, 2009

(54) DEPTH CORRELATION DEVICE FOR FIBER OPTIC LINE

(75) Inventors: Luis E. Mendez, Houston, TX (US); Stephen H. Poland, Blacksburg, VA (US)

(73) Assignee: Baker Hughes Incorporated, Houston, TX (US)

( * ) Notice: Subject to any disclaimer, the term of this patent is extended or adjusted under 35 U.S.C. 154(b) by 222 days.

(21) Appl. No.: 11/739,949

(22) Filed: Apr. 25, 2007

(65) Prior Publication Data

US 2008/0264631 A1 Oct. 30, 2008

(51) Int. Cl.
*E21B 47/12* (2006.01)

(52) U.S. Cl. ..... 166/250.01; 166/64; 166/66

(58) Field of Classification Search ..... 166/255.1, 166/250.01, 66; 73/152.02, 152.12, 152.13; 356/241.1–241.6

See application file for complete search history.

(56) References Cited

U.S. PATENT DOCUMENTS

| | | | | |
|---|---|---|---|---|
| 2,350,832 | A * | 6/1944 | Segesman | 324/368 |
| 5,581,024 | A | 12/1996 | Meyer, Jr. et al. | |
| 6,392,151 | B1 | 5/2002 | Rafie et al. | |
| 6,571,046 | B1 | 5/2003 | Hickey et al. | |
| 6,787,758 | B2 | 9/2004 | Tubel et al. | |
| 6,913,079 | B2 * | 7/2005 | Tubel | 166/250.01 |
| 6,995,899 | B2 | 2/2006 | Aronstam | |
| 6,997,256 | B2 * | 2/2006 | Williams et al. | 166/250.03 |
| 7,040,390 | B2 | 5/2006 | Tubel et al. | |
| 7,168,311 | B2 | 1/2007 | Zisk, Jr. et al. | |
| 7,201,221 | B2 | 4/2007 | Tubel et al. | |
| 7,204,308 | B2 * | 4/2007 | Dudley et al. | 166/254.1 |
| 7,433,551 | B2 | 10/2008 | Poland et al. | |
| 7,458,421 | B2 * | 12/2008 | Barrow et al. | 166/255.1 |
| 2003/0234921 | A1 | 12/2003 | Yamate et al. | |
| 2004/0011950 | A1 | 1/2004 | Harkins | |
| 2004/0140092 | A1 | 7/2004 | Robison | |
| 2008/0204703 | A1 * | 8/2008 | Hernandezs-Solis et al. | 356/6 |

* cited by examiner

*Primary Examiner*—David J Bagnell
*Assistant Examiner*—James G. Sayre
(74) *Attorney, Agent, or Firm*—Steve Rosenblatt

(57) ABSTRACT

A correlation system is provided to allow association of readings from a cable that is supported by a string but that is coiled around or has slack in one or many locations to a specific location along the string itself. Heat sources can be placed along the string to periodically or continuously give off heat that can be detected by a cable such as a fiber optic. The location of the sources along the string is known and the location along the cable is determined from the location on the cable where the heat generated by the source is sensed. One or more sources can be used and correlation can be by periodic sampling or in real time. The sources may by powered locally or from the surface.

22 Claims, 1 Drawing Sheet

DEPTH CORRELATION DEVICE FOR FIBER OPTIC LINE

FIELD OF THE INVENTION

The field of the invention is the use of fiber optic cable to measure downhole conditions and more particularly a device that correlates a length along the cable to an associated well location.

BACKGROUND OF THE INVENTION

Temperature distribution downhole can be part of the data that a well operator needs to monitor downhole conditions. One way this information has been obtained in the past is through a fiber optic cable that extends from the surface to the downhole completion(s) and gives data at the surface of the sensed temperature at any point along the fiber optic cable. The problem is that to accommodate the various equipment on the string as well as to facilitate assembly of the string and associated equipment, requires that slack be built into the fiber optic cable. Generally, this slack is provided by adding coils around portions of the string. The slack that is provided allows running in with minimal damage to the cable and facilitates assembly of the string and associated equipment that it supports.

The problem is that the provision of slack at one or multiple locations along the length of the cable creates a disassociation between the position along the length of the cable and the physical location of that portion of the cable with respect to the running length of tubular into the well. As a result, it becomes unclear as to where in the well the temperature profile transmitted through the cable is actually located in the well.

Additionally, an optical fiber cable within a line can have a variable length, which can occur as a result in variability of the overstuffing used when installing the fiber optic cable into the line. Optical fiber may be inserted into the line during either manufacture of the line prior to downhole installation, or after the line has been installed downhole. Overstuffing may occur as a natural consequence of the manufacturing process, but is also done intentionally to compensate for differential rates of thermal expansion between the cable itself and the line into which it is placed. Typically the overstuffing can account for a few tenths of a percent of the overall length but can vary from about 1% to several percent of the cable length.

Another uncertainty in depth correlation of the readings obtained through a fiber optic is the variability of the refractive index of the fiber optic material in bulk or as a function of location along its length. The refractive index determines the speed at which light travels in the optical fiber cable, therefore for fiber optic measurement techniques such as optical time-domain reflectometry (OTDR) and other intrinsic sensing techniques that rely on knowledge of the optical fiber refractive index, errors in estimating the refractive index of the optical fiber creates errors in positional accuracy of the measurement. The present invention allows the use of location markers at known depths to correlate the received data to a depth while minimizing the uncertainties from the variables discussed above.

While the context of the invention is described in terms of a fiber optic measuring temperature, the scope of the invention includes other systems where there is not a direct correlation, for whatever reason, between line length and string length. It should be noted that another reason slack is deliberately added to a line supported by a tubing string is that well conditions or supported weight can result in length changes of the string itself and the slack in the associated cable that it supports is put there to allow the cable to grow with the string that supports it without damage such as a tensile stress that can result in the shear failure of the cable.

The present invention addresses the need to correlate a specific length along the cable with a location along the supporting tubular downhole. It does this by placing a heat source at a known location on the string and sensing its output at a known location on the cable. In fact the correlation signal can be any signal that can be transmitted through the cable such as a vibration signal, as one example. From one or more correlation locations the results seen at the surface from the cable can be correlated to a physical location in the wellbore. While the preferred embodiment will be described in detail below in the context of correlation using temperature as the variable, those skilled in the art will understand that the invention relates to correlation techniques in general regardless of the measured variable. The correlation can also be provided in real time or periodically on a sample interval basis. These and other aspects of the present invention will be more apparent to those skilled in the art from a review of the description of the preferred embodiment and the associated drawings while the full scope of the invention will be found in the claims attached below.

SUMMARY OF THE INVENTION

A correlation system is provided to allow association of readings from a cable that is supported by a string but that is coiled around or has slack in one or many locations to a specific location along the string itself. Heat sources can be placed along the string to periodically or continuously give off heat that can be detected by a cable such as a fiber optic. The location of the sources along the string is known and the location along the cable is determined from the location on the cable where the heat generated by the source is sensed. One or more sources can be used and correlation can be by periodic sampling or in real time. The sources may by powered locally or from the surface.

DETAILED DESCRIPTION OF THE PREFERRED EMBODIMENT

Figure 1:
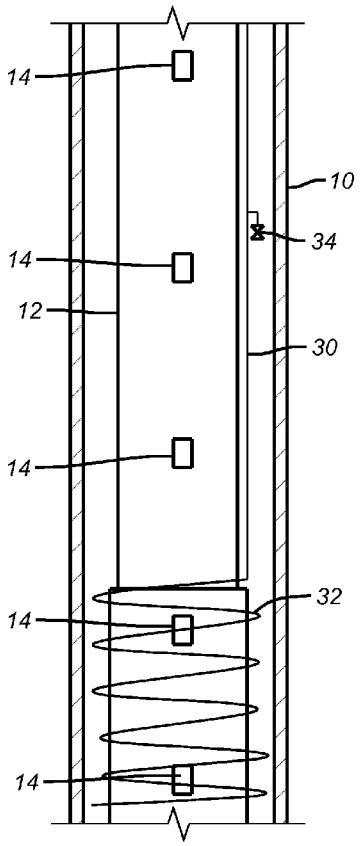
FIG. 1 is a schematic representation of a downhole view showing the sources of heat and the line with slack that is supported by the tubular string.
Figure 2:
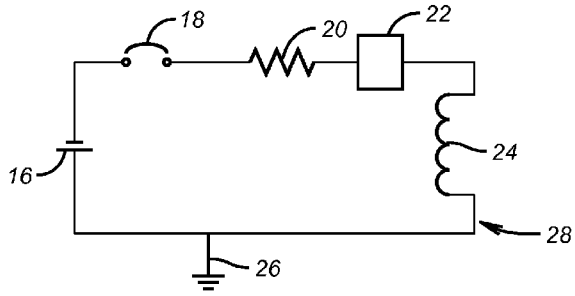
FIG. 2 is a simple circuit diagram of the operation of a given source that produces heat.

FIG. 1 shows casing 10 surrounding tubing string 12 in a wellbore. Alternatively, open hole applications are within the scope of the invention. Mounted to the string 12 are devices 14 that in the preferred embodiment emit heat. While the devices 14 are shown to be identical in the preferred embodiment, they don't all need to be the same nor do they all need to operate on the same principle. In the preferred embodiment the devices 14 are heat generators that can be self contained, as illustrated in more detail in FIG. 2. The circuit includes a power supply 16 a switch 18, a resistor 20, a thermostat 22 and a heating coil 24. Alternatively, power can come from outside the interval where the devices 14 are located, such as from the surface such as by an adjacent line. The circuit can include a ground 26 to the string 12. The switch 18 can be actuated on and off in a number of ways from the surface or locally from a cycle timer that can be made part of the circuit 28.

A line 30 is supported by the string 12 but also has slack such as in the form of at least one coiled section 32 for example. For that reason there is not a direct correlation between linear distance along the string 12 and linear distance along the line 30. In the preferred embodiment the line 30 is a fiber optic line that is placed adjacent the string 12 to transmit temperature profiles along the depth of the well. Those skilled in the art will appreciate that there is a disconnect between the temperature profile transmitted to the surface that is representative of the running length of the line 30 and the actual location of part or all of that profile because of the slack issue where there is measurably more running length of line 30 than string and associated downhole equipment 12. However, the position of the devices 14 is known from assembly as to the individual location and their depth in the wellbore. It is appreciated that the string 12 exhibits some elongation from hanging load, its own weight and thermal effects from well fluids that can be computed for a given installation. Alternatively, after the string 12 is in place a survey or locator tool can pinpoint the precise locations of the devices 14. The level of heat generated by the devices 14 is readily apparent on the temperature profile sensed by line 30 so that in effect depth in the wellbore markers are overlaid on the profile of well temperatures measured along the length of the line 30. In that way, the profile transmitted by line 30 can be associated with specific locations on the string 12 and thus specific positions in the wellbore itself.

The invention is broader than the above described preferred embodiment and is directed to any system that correlates location of sensed data from the wellbore or in the other direction that operates on one system that does not have a direct correlation to the length of string in the wellbore. The invention uses a reference signal that can appear in a variety of forms, where that signal has a known relation to the location on the string in the well. That reference signal can be either sent to the surface or processed downhole so that well data collected by line 30 can be correlated to specific well depths in real time or otherwise. The reference to "line" 30 is generic and is intended to encompass lines that can take samples in the wellbore or deliver material in the wellbore for a variety of purposes. For those purposes, valves such as 34 can be added on line 30 and their location correlated to a tubing position. While the discussion of the preferred embodiment has focused on one line 30 such focus is illustrative and multiple lines can be used for similar or different purposes with each correlated as to actual depth to account for line slack that is required during the assembly process. Any given line can be run one way down all or part of a well or can be formed in a u-shape and run down the well and back up so as to accommodate fluid circulation in one or opposed directions.

The above description is illustrative of the preferred embodiment and many modifications may be made by those skilled in the art without departing from the invention whose scope is to be determined from the literal and equivalent scope of the claims below.

We claim:

1. A wellbore depth correlation apparatus, comprising:

a tubular string interval extending in a wellbore;

a line adjacent said string that in said interval is a different length than said string;

at least one device mounted to said string at a predetermined location and capable of correlating actual running length of said line to a position in said interval where said device is mounted.

2. The apparatus of claim 1, wherein:

said device transmits a signal sensed by said line.

3. The apparatus of claim 2, wherein:

said line collects data from the wellbore.

4. The apparatus of claim 3, wherein:

said line comprises a fiber optic.

5. The apparatus of claim 4, wherein:

said line collects wellbore temperature data.

6. The apparatus of claim 5, wherein:

said device transmits heat or vibration to said fiber optic.

7. The apparatus of claim 6, wherein:

said transmitted heat is discretely detected among the well temperature data collected by said fiber optic.

8. The apparatus of claim 7, wherein:

said fiber optic is coiled around said string at least once in said interval.

9. A wellbore depth correlation apparatus, comprising:

a tubular string interval extending in a wellbore;

a line adjacent said string that in said interval is a different length than said string;

at least one device mounted to said string at a predetermined location and capable of correlating actual running length of said line to a position in said interval where said device is mounted;

said device transmits a signal sensed by said line;

said line collects data from the wellbore;

said line comprises a fiber optic;

said line collects wellbore temperature data;

said device transmits heat or vibration to said fiber optic;

said transmitted heat is discretely detected among the well temperature data collected by said fiber optic;

said line has slack in said interval.

10. The apparatus of claim 7, wherein:

said transmitted heat from said device is communicated out of said interval with the collected well temperature data.

11. The apparatus of claim 6, wherein:

said device comprises a local power supply.

12. The apparatus of claim 11, wherein:

said device generates heat or vibration either constantly or intermittently.

13. The apparatus of claim 1, wherein:

said at least one device comprises a plurality of devices at predetermined locations in said interval.

14. The apparatus of claim 13, wherein:

said devices are identical.

15. The apparatus of claim 13, wherein:

said line comprises a fiber optic and said devices transmit heat sensed by said fiber optic or vibration discretely from other well temperature data.

16. The apparatus of claim 13, wherein:

said line either senses a well parameter, delivers material to said interval or collects material from said interval.

17. A wellbore depth correlation apparatus, comprising:

a tubular string interval extending in a wellbore;

a line adjacent said string that in said interval is a different length than said string;

at least one device mounted to said string at a predetermined location and capable of correlating actual running length of said line to a position in said interval where said device is mounted;

said at least one device comprises a plurality of devices at predetermined locations in said interval;

said line is at least in part coiled around said string.

18. The apparatus of claim 15, wherein:

said devices transmit heat or vibration in real time or intermittently.

19. The apparatus of claim 18, wherein:

said devices are locally powered or powered from outside the interval.

20. The apparatus of claim 13, wherein:

said predetermined locations are identical.

21. The apparatus of claim 4, wherein:

the refractive index of the fiber optic is either variable along its length or varies from the expected value for the material used.

22. The apparatus of claim 15, wherein:

the refractive index of the fiber optic is either variable along its length or varies from the expected value for the material used.

* * * * *